US005325557A

United States Patent [19]

Penuela

[11] Patent Number: 5,325,557

[45] Date of Patent: Jul. 5, 1994

[54] PORTABLE, DEMOUNTABLE BRIDGE TO FORD RIVERS AND THE LIKE

[76] Inventor: Julio P. Penuela, Transversal 3a. No. 87-15, Santa Fé de Bogotá, Colombia

[21] Appl. No.: 824,142

[22] Filed: Jan. 22, 1992

[51] Int. Cl.[5] ..... E01D 15/12; E01D 5/00; E01D 11/00

[52] U.S. Cl. ..... 14/8; 14/2.4; 14/21

[58] Field of Search ..... 14/2.4, 3, 4, 6–8, 14/18–19, 21, 35

[56] References Cited

U.S. PATENT DOCUMENTS

| | | | |
|---|---|---|---|
| 763,222 | 6/1904 | Driessche | 14/7 X |
| 1,666,586 | 4/1928 | Wait | 14/8 X |
| 2,417,825 | 3/1947 | Janke, Sr. | 14/3 |
| 3,027,633 | 3/1962 | Murphy | 14/7 |
| 4,651,375 | 3/1987 | Macchi | 14/7 |

*Primary Examiner*—Kenneth J. Dorner
*Assistant Examiner*—Nancy Mulcare
*Attorney, Agent, or Firm*—Beveridge, DeGrandi, Weilacher & Young

[57] ABSTRACT

A portable, demountable bridge to ford rivers and the like, includes a pair of footings for supporting the bridge buried at different heights in the soil on one side of the river. The footing closer to the river receives a load in a downward direction, and the footing further from the river resists an upward force produced by the weight of the bridge and objects on the bridge. Soil located over this further footing acts as a counterweight of the bridge. At least two bridge supporting units are located over the footing closer to the river. Preferably each supporting unit includes two support tubes. A removable first bracket is fixed to each supporting unit, and a second bracket is connected to the first bracket. The panels forming a roadway track for the bridge are connected to the second bracket via a first elongated support. A second elongated support connects to the footing further from the river to the second bracket. The supporting units are connected to the footing closer to the river through a pivot point which is made of two brackets connected together with a rod. A protective railing may be included on the roadway track of the bridge. The protective railing includes a plurality of U-shaped elements connected to the panel of the roadway track, and crossbars connect at least two of the U-shaped elements.

13 Claims, 6 Drawing Sheets

PORTABLE, DEMOUNTABLE BRIDGE TO FORD RIVERS AND THE LIKE

FIELD OF THE INVENTION

Figure 1:
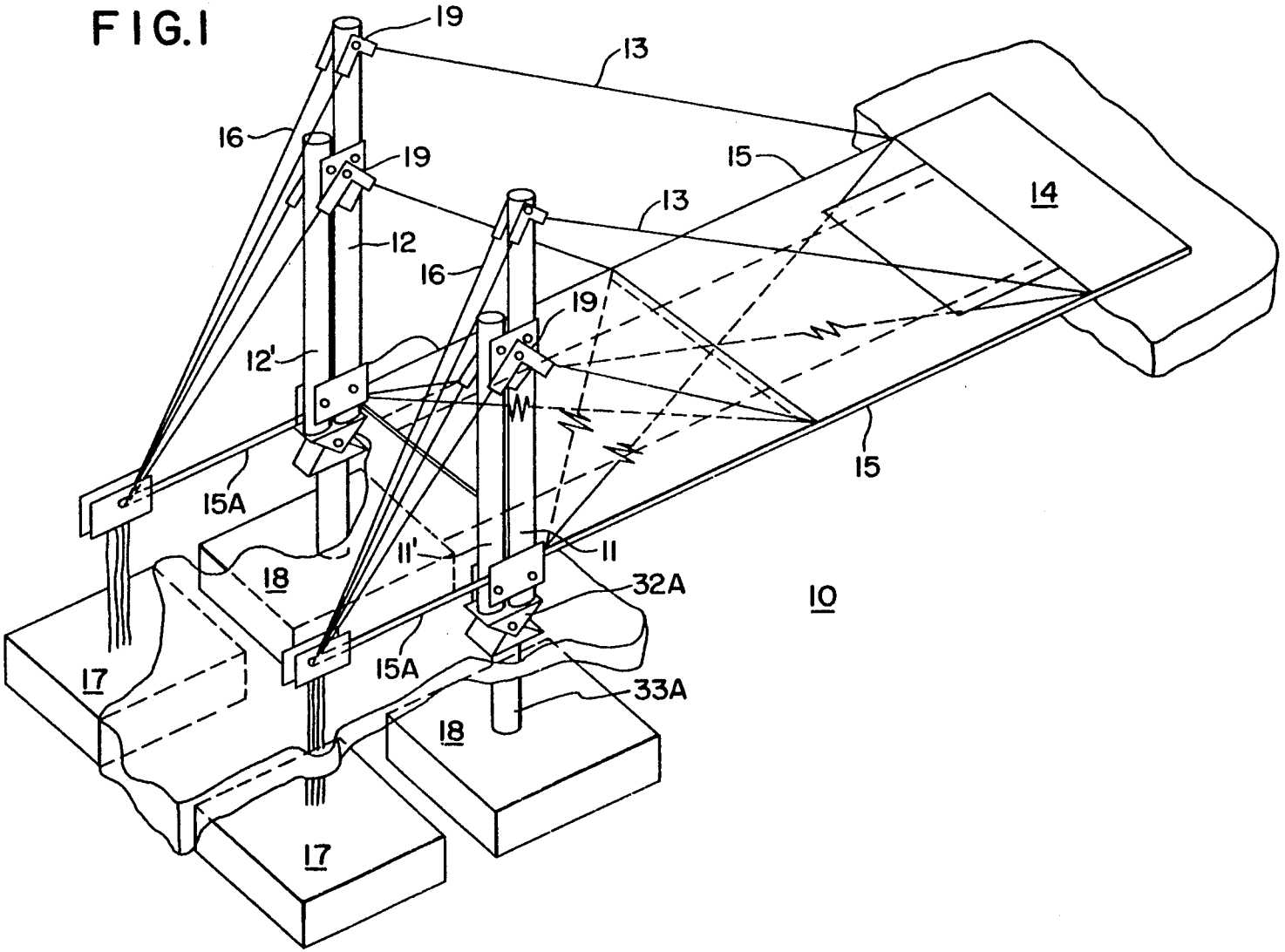

The present invention is related to bridges. This particular invention is related to demountable bridges, of the Bailey type, which can be assembled and disassembled very quickly and at a very low cost, making it very economical and versatile.

BACKGROUND THE INVENTION

In Civil Engineering works, one of the biggest challenges is the designing of bridges to clean fluvial obstacles, such as rivers and streams and keeping the costs as economical as possible, and assuring their construction and development in the shortest time possible. The traditional structures have supports on each side of the river or creek, besides the bases embedded in the floor, are to conform support structures for the deck or tracks on which the vehicles circulate, all of which require complex elaboration of connecting parts and elements. In addition to this, there is also the need for civil works for sinking of the bases and the supports necessary to support the deck of the bridge.

Demountable bridges have been developed, especially of the military type, to cross rivers and waterways. Probably the most renowed and divulged is the Bailey bridge, assembled in a mecano or erector fashion that allows it to be disassembled when it is no longer needed, or instaled in another site when needed, resulting in enornmous savings of time and expenses. However, the Bailey bridges are somewhat complex due to the number of parts and pieces that have to be joined and fitted, thus requiring a qualified and skilled labor force to assemble and dismount them.

There exists, however, an urgent need in the industry for provisional bridges that will permit the crossing of waterways as quickly and safely as possible. Provisional bridges that can be dismantle once the waterway is crossed and can be installed at another site if needed, consequently saving a great amount of materials and expenses.

Also, another important factor is that the bridge can be assembled and disassembled in the shortest time possible because in many economical type operations, the time factor is fundamental.

This is particularly evident in mining explotations, especially in the exploration and explotation of petroleum, as they generally take place in isolated and inhospitable places with, in most cases, no conventional roads. Heavy and expensive equipment has to be carried along trails and provisional roads where it is not feasible to build permanent bridges.

OBJECTIVES OF THE INVENTION

The principal objective of the invention is to design a removable bridge that can be easily and economically installed, demounted from the location just as quickly and economically, either to recuperate it or to install it in another location.

Another main objective of this invention is to design a bridge that can be assembled and disassembled in a minimum amount of time, therefore reducing the costs of labor and the maintenance of personel.

Another objective of the invention is to provide a bridge structure that can be recuperated without a great loss of materials, one that can be assembled and disassembled almost like a mecano, thus reducing a wide variety and number of tools and concrete material needed for the construction.

Another objective of the invention is to provide structure for bridges that does not require the elaboration of bearing walls as in the case of traditional bridges, and one in which the deck of the bridge is independent of the support structure.

Equally another objective of the invention is to provide a structure for portable bridges in which the principal elements of support are submitted to simple mechanical stress, thereby giving the structure maximum safety, carrying out in the structure the supposed theory that stresses are concentric with the principal axis of the elements.

Therefore the objective is to introduce a static model of a cable bridge wherein the groundwork is provided such that the stresses are present only in the vertical direction.

Also another objective of the invention is to design connections between the elements of support and the elements of suspension in order to establish the simple mechanical stresses, concentric with the principal axis of the elements.

One of the most important objectives is to produce stresses only in the vertical direction the foundation structure, either upwards or downwards; this, due to the geometry of the superstructure, makes the horizontal component, associated with cable bridges, annul itself.

Another objective is to avoid undermining, now that no wall plates casted down into the riverbed are used fop supports. Instead it is supported from the dry part of the bridge site.

Another objective is that thoughout the superstructure, the span of the bridge be subdivided in smaller spans which lessen the resistant sections needed to support the deck of the bridge, thus lowering costs.

This feature is the result of the aerial point which is fixed in space, and serves as a support to the transversal trusses over which the deck of the bridge is supported.

Another objective is to avoid the use of false work. The structure of the bridge is flung from the riverbank and is supported by its own elements; its parts are pin connected requiring no extra equipment.

Equally another objective is that the bridge be adjustable to any topographical condition of the bridge site level.

An important objective is that the bridge need minimum bearing capacity and hydrometric conditions.

Another additional objective is that the counterweight required by the bridge be the ground, using it as a counterweight in a vertical direction downwards, and as a support in a vertical direction upwards.

Also an objective is to obtain a lightweight bridge which results in much lower costs.

Likewise, another objective of the bridge is in its trusses. The objective is not to use any of the typical existing framework, and in this way introduce a new geometry.

Another objective is to support the bottom part of principal supporting columns in a structural element that carries out the function of a hinge.

Likewise, another objective is that the load transmissor element be just one column that goes from the height of the hinge to the level of the footing.

It is also an objective that the horizontal brake forces be absorbed by the structural element that extends from the stabilizer footing of the bridge to the deck of the bridge.

THE INVENTION

In the desired form of the invention, we have designed a portable structure for bridges, supported by only one abutment. Traditionally the concept of bridges is that they have to be supported on abutments of casted concrete embedded in an underwater excavation on both sides of the aqueous avenue. These abutments are submitted to possible phenomenons of undermining by currents of the river that lap the soil around them, destroying the support these abutments have and, after a time, making them collapse.

In our invention, this possible phenomenon is completely eliminated due to the fact that no concrete abutments are founded.

In the preferred form of this invention, the support is "buried" in the ground at different depths according to the conditions of the soil, so the currents cannot lap the foundation around the support.

Also, these supports are founded quite a distance from the water course which gives a coefficient of safety against the possibility of these currents reaching the supports. Even in severe flood tides, the water will always stay above the supports, thereby eliminating any erosive effects.

Even though in the desired performance of the invention the buried supports are preferably distributed on just one side of the river, the supports being strong enough to support both the weight of the bridge deck and the vehicles that cross the river, but if necessary, or if the spans are not too large, supports can be established on both sides of the river. However the preferred form is, if the spans are not too large, to use just one support on one of the banks of the river.

The other end of the bridge deck will rest on a simple footing resting on the ground.

SUPPORTS OF THE DECK

Basically, the concept of the bridge consists in a pair of metallic columns, one on each side of the route of the vehicle track, and both columns situated on the same side of the riverbank. The reason for using this pair of columns is that they serve as supports to the elements of connection for the elements submitted to axial tension or axial compression that support the bridge deck. These support elements receive the truss rods in such a way that the results of the stress exercised on the bridge deck are transmitted to the support base or shoe, through the two metallic columns, in a parallel form to them without overloading either one in particular, thus the resulting stress is perfectly perpendicular to the support shoe, and almost equal on each metallic column.

This application of the resulting stress distribute the loads in such a manner that no point is overloaded and weakened as a result.

It is evident that the vertical support columns of the bridge are of a metallic nature, a standard kind of steel used for this type of civil works. They could be hollow tubes or solid bars. Also, they could be square or rectangular profiles equally solid or hollow. In this case, hollow steel tubes are preferred because they are lighter and their resistance is similar to the solid cylindrical bars.

The columns are placed vertically, one in front of the other, leaving just enough distance to receive the elements of support of the truss rods that support the bridge deck.

At the ends that are connected to the footing, you can use a solid plate or projections for embedment in the concrete fixing, as found in the traditional manner. Although it is preferred to use only one pair of columns to support the truss rods that hold the bridge deck, several of these pairs of columns can be employed to support the various elongated support members that will hold up individual panels of the bridge deck. In this option, the plurality of columns are supported by one common footing, and each will receive at its end only one support elongated support members of a panel of the bridge deck. In the case where just one column is used, the elements of support of each elongated support member will be placed at different heights of the columns. The bridge additionally posseses two columns that originate in the common footing and serve as supports to the transversal trusses where the bridge deck begins.

THE PIVOT

Figure 6B:
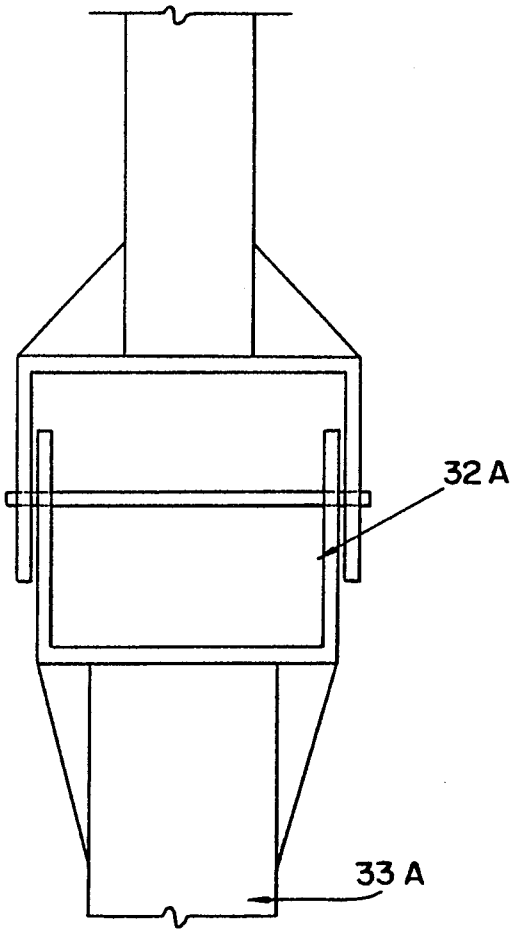
Figure 6A:
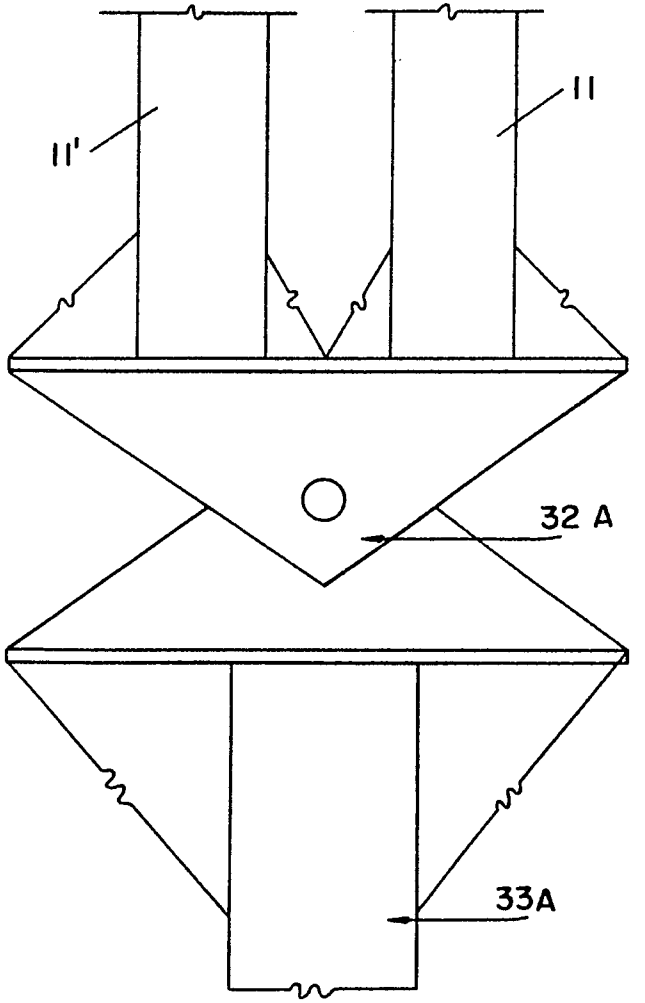

In the lower parts of the piles 11, 11' and 12, 12', below the unions produced by the piles and horizontal columns 15 and 15', a pivot 32A is located, as can be seen in FIGS. 6A and 6B. By using this pivot the effective span of the piles is reduced to half. Another advantage of its use is that starting from its level until the level of the bearing, only one column 33A is required, this being supported in the footing, and then braced in the ground.

THE ELONGATED SUPPORT MEMBERS

The elongated support members are steel cables or rods whose upper ends are secured to the element of support of the elongated support members whereas the element of support will be supported by both tubes or metallic blocks, preferably by means of bolts that pass through the block or tube as will be described in more detail hereinbelow. The lower end of each elongated support member is secured to a panel of the bridge deck so this panel of the bridge deck can transmit the load present in this point of the deck to the column through this mentioned template.

At the height of the lower ends of the elongated support members there are transversal beams that unite the two sides of the bridge, thereby unifying the structure and permitting that between and over them the bridge deck be extended, this being composed of planks of metallic plates that cross the spans between the support beams.

THE ELEMENTS OF SUPPORT OF THE ELONGATED SUPPORT MEMBER AND UNIONS TO THE SYSTEM

These elements of support of the elongated support members are decisive in the invention, chiefly because through them it is possible for the resultant stress of the loads applied to the bridge deck to project in a "simple" manner, that is, as just one resultant that projects parallely between the two respective columns falling perpendicularly on the support being, equidistantly to the points of support of the respective columns, and in this form transmitting the resultant stress directly to the floor without overloading certain stress directly on either of the two columns.

To succeed in getting the resultant stress to transmit effectively in a "simple" form, falling perpendicularly on the common support bearer to the two columns, we have devised an element in which the elongated support member is not supported directly on either of the two columns but on an intermediate point between them, so that the moment of each knot in the structure will theoretically equal to $\phi$. The element of union or support of the elements (elongated support member, columns), consists basically of two metallic plates or brackets, facing each other, and supported on the vertical columns, and preferably fastening these metallic plates or brackets to the columns with removable built-pins or with screws.

Between the two brackets or metallic plates, there is a bolt that passes all the way through them, from one side to the other, and this bolt holds another two brackets, one on each side, to receive the respective elongated support members or cables. Assuming that the elongated support member or cables which faster the deck to the column do not meet at equal angles on the inner support bracket, these brackets are arranged in angular positions on the common support bolt, depending on the angle of incidence to which two support brackets conform to coincide with the direction of the cables that meet with it. It can be observed that the stress transmitted by elongated support member on the column is transmitted through the support brackets of the respective elongated support member to the common bolt of each support brackets of the templates. The bolt then transmits the stress to the stabilizing brackets of the unit on the columns, this is, in the center point of the two mentioned columns. Thus, the resultant stress will be applied to this center point with no possibility of its displacement toward one side or the other of the point, which is an intermediate point of the two mentioned columns. The resultant of the stress will be transmitted equidistant and equivalently to the two columns, in a parallel form to the same, causing the resultant to fall on the support bearing in a perpendicular form to the same.

SUPPORTING ELEMENTS FROM THE BRIDGE DECK TO THE SYSTEM

The bridge deck is supported by horizontal trusses that consist of rods or tubes that are anchored at the ends and rest on the ground, and of the bases of the columns or the poles mentioned before, preferably one individual for each free distance and on which an elongated support member is fixed. Thus, each truss will be of a different length, this depending on the point where the elongated support member is to be fixed, and the arrangement of each truss anchored on each side of the supporting pole of the bridge. This limits the span that covers the bridge to the maximum longitude of the individual truss that can be collocated; if the spans are larger, a support just like the one described before and braced in the opposite riverbank should be used. The free ends projected over the river are supported through the respective elongated support members, that are tied to the ends of the columns or the posts before mentioned. These elongated support members are extended angularly from the column to the end of the horizontal support or truss. The subsequent panel that follow the initial ones are supported on both ends by the columns with the same elongated support members, or additional ones; and they are joined together by means of clamps that are fastened to the adjacent ends. In each point of a union or knot, of the free end of the panel with the respectively elongated support member, a transverse truss is projected horizontally that joins the two sides of the bridge, terminating in the manner of cross-pieces and over which new individual longitudinal trusses are fixed, as supports to hold the upper floor of the bridge deck, made up of planks or tiles, as desired.

Our invention, will be understood more clearly by referring to the annexed drawings, in which:

FIG. 1.—Presents a schematic perspective of the bridge we have designed.

Figure 2A:
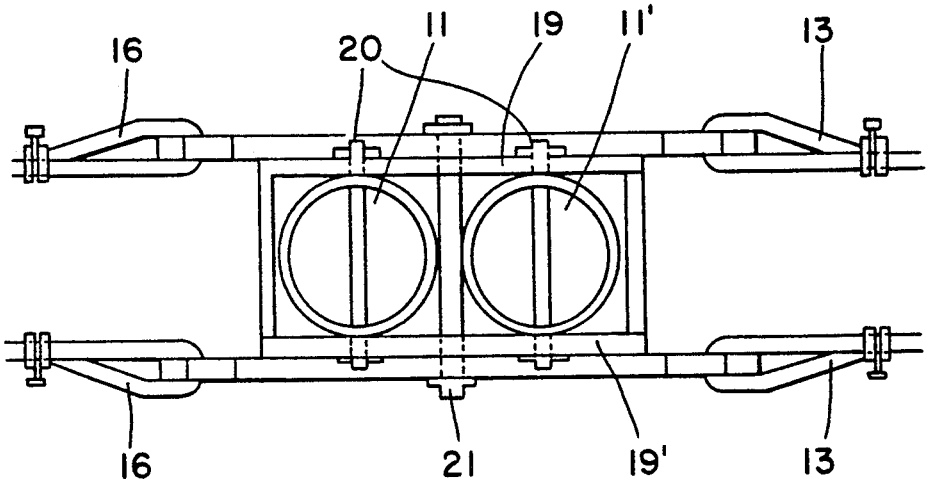
Figure 2B:
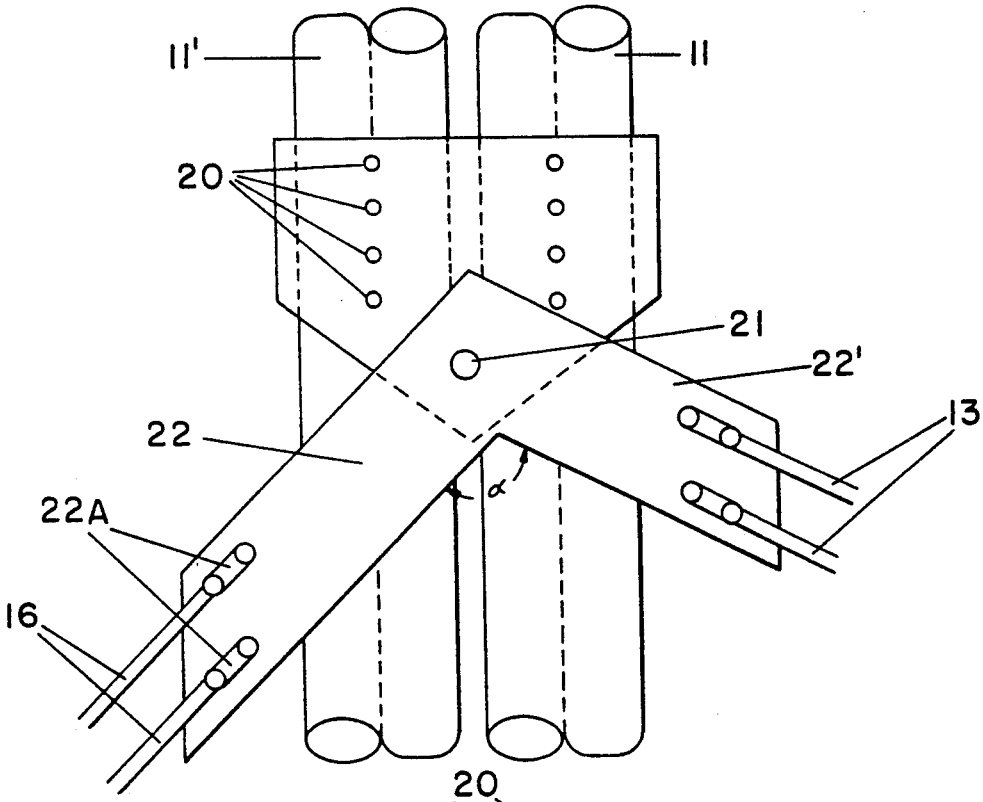
Figure 2C:
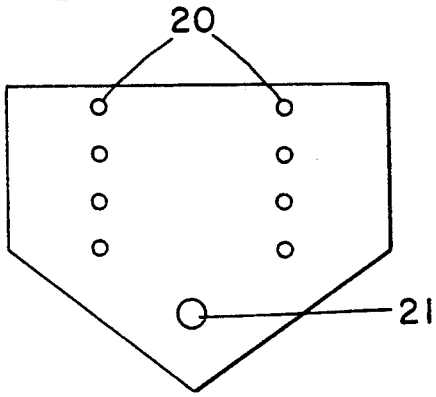

FIGS. 2A, 2B and 2C.—Illustrate the union of the elongated support member to the supporting column.

Figure 3C:
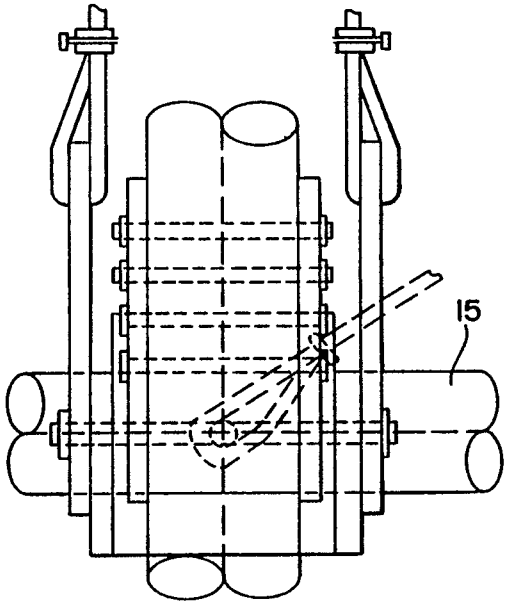
Figure 3B:
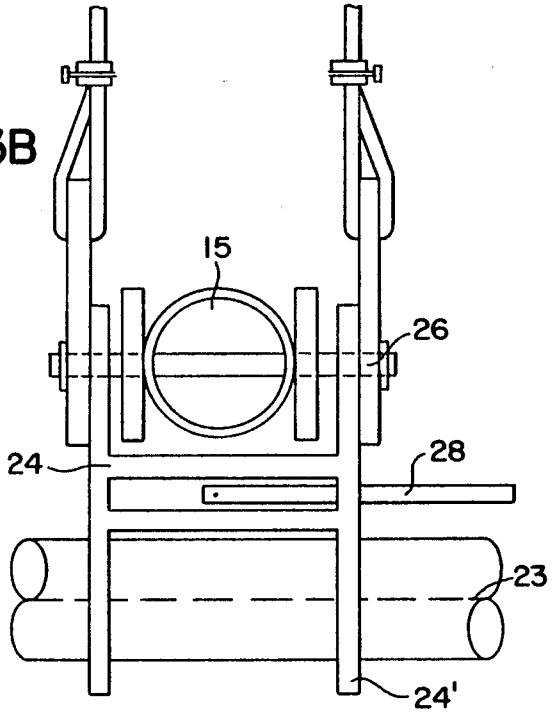
Figure 3A:
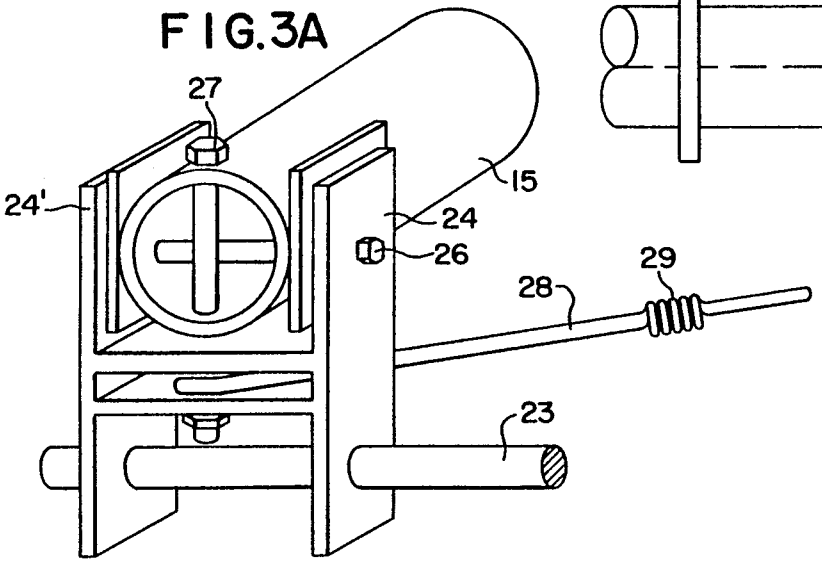

FIGS. 3A, 3B and 3C.—Show a general view of the bridge deck, that specifies the aerial points.

Figure 4:
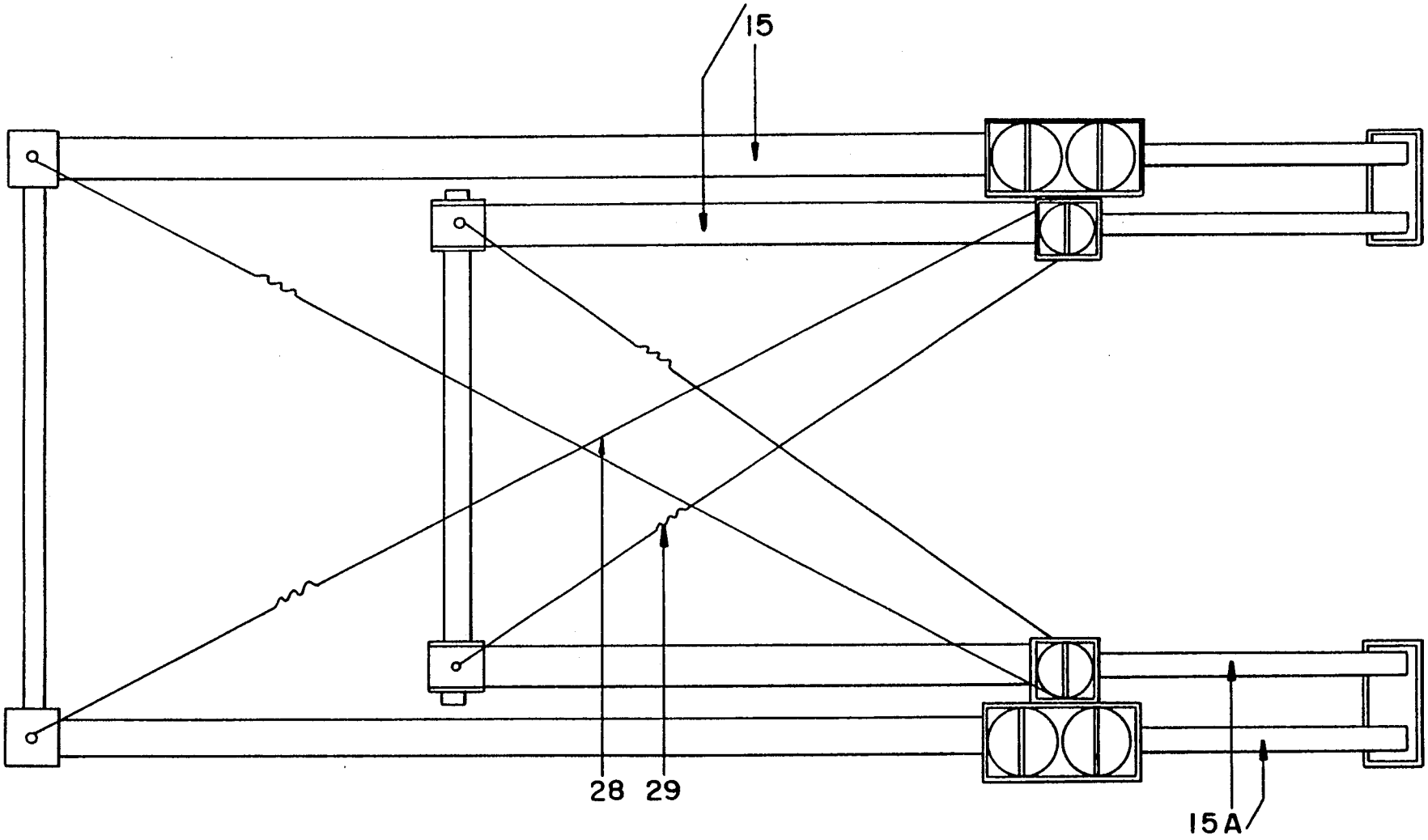

FIG. 4.—Illustrates the top view, of the general view of the bridge deck, shown in FIG. 1

Figure 5:
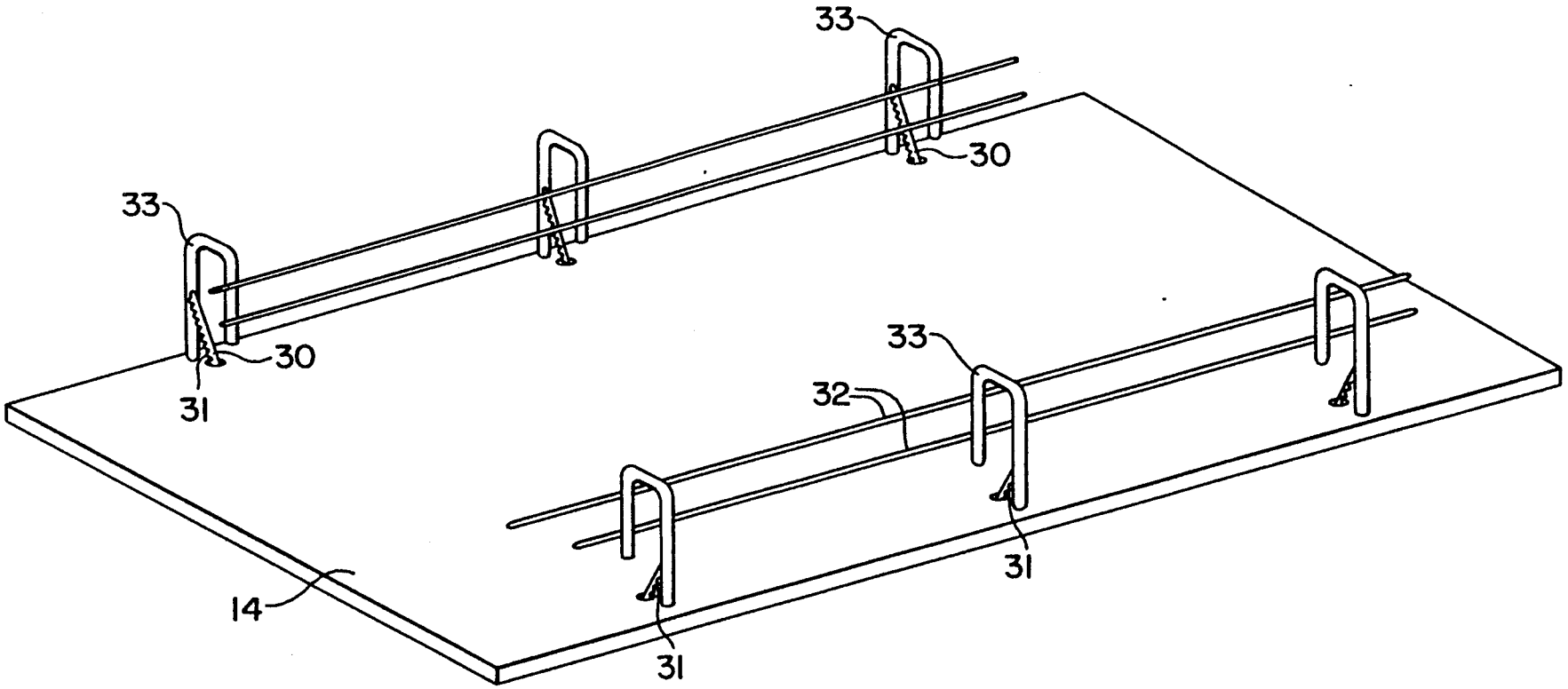

FIG. 5.—Shows the protective side railings of the bridge.

FIGS. 6A and 6B show the pivot between the piles and columns of the bridge.

Referring to FIG. 1, you can observe that the bridge of our invention, that crosses the river 10, is erected of two columns, each of which is conformed of two tubed shaped elements, parallel to each other or posts 11, 11' and 12, 12' respectively, from which hang the elongated support member 13, that support the deck 14, where the vehicles circulate. FIG. 1 shows half of the deck covered with tiles, planks, or similar elements, that completely close the span between the horizontal supporting elements 15, that cross the river 10, and the other half is shown uncovered in orther to illustrate the unions between the horizontal panels of the deck.

It can be seen in the drawing that columns 11, 11' and 12, 12', are also fastened through the elongated support members 16 to the block 17 "buried" in the earth deep enough, so the layer of soil that covers them will contribute sufficient weight, thus helping substantially the passive resistance of the terrain, and in this form preventing columns 11, 11' and 12, 12' respectively, from bending forward under tension.

The horizontal force annuls itself, in the connection between elements 15 and 15A, thus obtaining only vertical stress on the footing, which receives all the force, without stressing columns 11, 11' and 12, 12'.

It can also be noticed in the drawing that the columns 11, 11' and 12, 12' are braced in the ground at a sufficient depth, to remain under the river bed 10, and distant from the river bank, so in case the river rises substantially and floods, the rising tide will pass over the bearing 18, causing no undermining effects on the bases.

It can be observed in the drawing, that the elongated support members or 13 and 16, are supported by the respective columns 11, 11' and 12, 12', by means of the support elements 19 of the elongated support members, shown in greater detail later on, with reference to FIG. 2.

As you can see in the drawing, only the support columns of elongated support members and the bridgedeck on one side of the river bank are illustrated, whereas on the opposite side of the river, there is no illustrated type of structure on that riverbank. This situation is possible and desired because the bridge can and should work as an "aerial point", only one end being supported by the post structure, while the opposite end suspends freely without the need of a substantial support, resting freely on the ground. In the illustrated case, FIG. 1, the opposite end on the riverbank simply rests on the ground, or if necessary, through an embankment, depending on the resistance of the ground, on that side of the river or the conditions needed for the access of the vehicles on that end. Obviously, the stress on that end is also partially or totally absorbed by the structures on the opposite riverbank. This characteristic of the invention, is possible for relatively short spans; in the case of larger spans it would be necessary to use a system of support identical to the one on the opposite riverbank.

In FIG. 2, we have illustrated the tying elements of the elongated support members and 16 respectively, this can be elaborated in cable or in tube as shown in FIG. 2D. It can be also observed in the top view of FIG. 2A, that the tubes or cylinders 11, 11' or 12, 12' lay parallel to each other, slightly distanced, and secured between the support element conformed on the two metallic plates or brackets 19, 19' that are fastened together, and to both tubes by means of removable bolts 20 and secured by nuts and lock nuts. The bolts 20, go completely through the tubes 11, 11'. The brackets 19, 19' are joined by the central bolt 21 that passes between the tubes 11, 11', distanced equidistantly from them.

As can be seen in the vertical view of FIG. 2B, on the central bolt 21, the new brackets or metallic plates 22 and 22' are fixed, which receive over an arm the elongated support members 13 that correspond to the deck 14 of the bridge, and on the other arm the elongated support members 16, that corresponds to the subterranean bracing plates. In this form you can see that the arms 22 and 22', form a geometric figure that varies in function of the angle of incidence "alpha", these arms 22 and 22'form together in the point of convergence. Thus it is noticeable that the alpha angle will be determinated by the inclinations of the elongated support members 13 and 16 respectively; this could vary depending on the location conditions. Even though the brackets 22 and 22', can be fitted as just one unitary piece, as can be seen in FIG. 2B, leaving the angular adjustment of the elongated support members 13 and 16 located in the tying points 22A and 22'A respectively, it is also possible and preferred to form the brackets 22 and 22' as separate units that are joined together and to the brackets 19 and 19' on bolt 21 thereby, converting into a pivotal bolt for brackets 22 and 22'.

In this manner, the brackets will open or close automatically according to the variations of the alpha angle complying to the different angular situations of the elongated support members 13 and 16.

In FIG. 2C, we present a frontal view of the metallical lamina or bracket 19, identical to 19', which have only two bolts, one on each side, and are fastened to the two tubes 11 and 11' respectively, and to the bracket faced to it, on the opposite side.

It is evident for the experts in the profession, that in place of two tubes 11, 11' (or 12, 12'), only one tube could be used, on which the bracket 19 would be fixed, which too would present a point of support (fulcrum) for the new brackets 22 and 22', over its axis of symmetry of the tube. Also, in these conditions the vector of forces would be displaced parallel to one side of the tube, and would fall perpendicularly on the support bearing of the pillars. Nevertheless, it is evident that in this manner, all the weight of the structure and the strain of the bridge will fall on just one tube, thus making its resistance specifications more demanding, and endangering the operation of the bridge. For these reasons, we prefer the use of at least two tubes, dividing the load on two supports.

In FIGS. 3 and 4, we have illustrated schematically the general outline of the bridge deck. The unions illustrated in these figures make up the aerial point, in other words, the support for the transverse trusses of the bridge deck in itself, just as the point of support (fulcrum) of the elongated support members that serves as a support to the superstructure, to obtain stability and transversal rigidity to the bridge, in the longitudinal sense.

The structural elements 15 that are extended horizontally to determine the "bed" of the roadway deck 14 (FIG. 1), can be similar to the vertical posts 11, 11', and elaborated of the same material, in other words, hollow tubes or solid axles, with preference to the hollow tubes as explained before.

Such structural elements 15 should also receive the transverse trusses that go from side to side of the deck, and serve as a support to the plates or planks that cover the roadway of the deck.

In FIG. 3A, we have illustrated in schematic perspective, the union between the horizontal structural element 15 with the transverse trusses 23. With the term "transverse trusses", we want to indicate the support sections that extend from one side to the other of the deck, in a transversal direction, and that serve as a support, to the new partial longitudinal trusses, on which the deck of the bridge is supported, conformed of tiles or planks that cross the span of the deck in the transversal direction. You can see in FIG. 3A that the free end of the structural element 15 is fastened to the transverse truss 23 by a pair of brackets or metallic plates, vertically fixed, and are adjusted one to the other by nuts or screws. As you can see in the Figure, the transverse truss 23 goes through the metallic plates or brackets 24, 24', in so much as the free end of the structural element 15, is secured between the brackets 24 and 24' by a bolt 26, this end being slightly distanced from the transverse truss 23. It can equally be seen in FIG. 2A, that the free end of the structural element 15, and the transverse 23 are equally fastened by the vertical bolt 27, leaving between both elements a light or space, that permits the end of the horizontal template 28, to bend its tip around vertical bolt 27, to tie the free end over itself, by using a "dog" knot (tie).

This horizontal template acts as a stabilizer template; the opposite end of the tied end is fastened to the bolt 27, at the foot of the column diametrically opposite, so that the two templates 28, of a same tiled panel will cross in the form of an X, as can be seen better in the top view of FIG. 4. As can be seen in FIG. 4, each horizontal template 28, is extended diagonally under the tiled panel of the bridge deck.

In FIG. 3B, we have illustrated a transversal section, of the connection of FIG. 3A, whereas in FIG. 3C, you can observe a top view of the same connection of FIG. 3A.

In FIG. 5, we have illustrated the protection railings of the bridge. These rails are not only for the purpose of protecting possible pedestrians crossing the bridge, but also to protect the actual structure of the bridge from unpredictable accidents that can occur, mitigating the heavy blows accidentally produced against the structure by the vehicles crossing the bridge.

As can be seen in FIG. 5, the rails of the bridge are supported by elements 33, bent in a U shape, with the inner foot suspended, in other words, a slight distance from the floor, and not fastened to it, whose range of distance from the other similar element across from it, on the other side, determines the traffic capacity of the roadway of the bridge. The outer foot is fixed to the bridge deck through a system of bolts and screws, and reinforced by the element 31. Underneath the element 29, you find the resort 30, that absorbs any heavy blow or hit by any vehicle to the railing, thus protecting the structure. On the inner free branch of the element in U, the horizontal poles 31, are fixed, which close the free space between the elements in U.

In this manner, we have described and illustrated our invention using a particular phraseology and some specific drawings, but by no means has it been our intention to limit the invention to such phraseology and drawings, because it would be evident to the experts in the profession, that they could make modifications in forms and details, within the spirit and capacities of the invention, that remains limited only in consequence through the claim that are enclosed.

I claim:

1. A portable, demountable bridge to ford rivers and the like, comprising:

a pair of footings for supporting the bridge, wherein the footings are buried at different heights in the soil, the footing buried closer to the object being crossed receiving a load in a downward direction, and the footing buried further from the object being crossed resisting an upward force that is produced by the bridge and objects on the bridge, wherein the soil is located directly over this further footing and acts as a counterweight of the bridge;

at least two bridge supporting units, wherein each bridge supporting unit includes least one pole unit that transfers load to the footing closer to the object being crossed, wherein each pole unit at least one support tube, wherein a removable first bracket is fixed to each supporting unit;

a second bracket removably connected to the first bracket;

at least one panel forming a roadway track for the bridge;

a first elongated support member connecting the panel to the second bracket; and a second elongated support member connecting the footing buried further from the object being crossed to the second bracket.

2. A bridge as defined in claim 1, wherein each pole unit includes at least two support tubes connected to one another by the first bracket.

3. A bridge as defined in claim 1, wherein the pole units are connected to the footing closer to the object being crossed though a pivot point.

4. A bridge as defined in claim 3, wherein the pivot point includes two brackets connected together with a rod.

5. A bridge as defined in claim 1, wherein the footings are buried in the soil at a location so that water currents of the object being crossed will not undermine a base of the footings in the event of high tide or flooding conditions.

6. A bridge as defined in claim 1, wherein the roadway track of the bridge is supported by at least two transverse trusses.

7. A bridge as defined in claim 1, further comprising a protective railing on the roadway track of the bridge.

8. A bridge as defined in claim 7, wherein the protective railing includes a plurality of U-shaped elements connected at one end thereof to the panel of the roadway track, wherein crossbars connect at least two of the U-shaped elements.

9. A bridge as defined in claim 8, wherein reinforcing elements are included to support the U-shaped elements against the panel of the roadway track.

10. A bridge as defined in claim 1, wherein at least one of the first or second elongated support members is a cable.

11. A bridge as defined in claim 1, wherein at least one of the first or second elongated support members is a rod.

12. A portable, demountable bridge to ford rivers and the like, comprising:

a pair of footings for supporting the bridge, wherein the footings are buried at different heights in the soil, the footing buried closer to the object being crossed receiving a load in a downward direction, and the footing buried further from the object being crossed resisting an upward force that is produced by the bridge and objects on the bridge, wherein the soil is located directly over this further footing and acts as a counterweight of the bridge;

at least two bridge supporting units, wherein each bridge supporting unit includes at least one pole unit that transfers load to the footing located closer to the object being crossed, wherein each pole unit includes at least two support tubes, wherein a removable first bracket is fixed to each supporting unit, the first bracket connecting the two support tubes;

a second bracket connected to the first bracket;

at least one panel forming a roadway track for the bridge;

a first elongated support member connecting the panel to the second bracket; and a second elongated support member connecting the footing buried further from the object being crossed to the second bracket.

13. A portable, demountable bridge to ford rivers and the like, comprising:

a pair of footings for supporting the bridge, wherein the footings are buried at different heights in the soil, the footing buried closer to the object being crossed receiving a load in a downward direction, and the footing buried further from the object being crossed resisting an upward force that is produced by the bridge and objects on the bridge, wherein the soil is located directly over this further footing and acts as a counterweight of the bridge;

at least two bridge supporting units, wherein each bridge supporting unit includes at least one pole unit that transfers load to the footing located closer to the object being crossed, wherein each pole unit includes at least one support tube, wherein a removable first bracket is fixed to each supporting unit;

a second bracket connected to the first bracket;

at least one panel forming a roadway track for the bridge;

a first elongated support member connecting the panel to the second bracket;

a second elongated support member connecting the footing buried further from the object being crossed to the second bracket; and a pivot point for connecting each pole unit to the footing closer to the object being crossed, wherein the pivot point includes two brackets connected together with a rod.

* * * * *